US009675839B2

(12) United States Patent
Dalebout et al.

(10) Patent No.: US 9,675,839 B2
(45) Date of Patent: Jun. 13, 2017

(54) TREADMILL WITH A TENSIONING MECHANISM FOR A SLATTED TREAD BELT

(71) Applicant: ICON Health & Fitness, Inc., Logan, UT (US)

(72) Inventors: William T. Dalebout, North Logan, UT (US); Gaylen Ercanbrack, Logan, UT (US); Ryan Workman, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 14/944,994

(22) Filed: Nov. 18, 2015

(65) Prior Publication Data

US 2016/0144225 A1 May 26, 2016

Related U.S. Application Data

(60) Provisional application No. 62/085,196, filed on Nov. 26, 2014.

(51) Int. Cl.

| | |
|---|---|
| ***A63B 22/00*** | (2006.01) |
| ***A63B 22/02*** | (2006.01) |
| *A63B 71/06* | (2006.01) |
| *A63B 69/16* | (2006.01) |
| *A63B 21/22* | (2006.01) |
| *A63B 24/00* | (2006.01) |

(52) U.S. Cl.

CPC ..... *A63B 22/02* (2013.01); *A63B 22/0285* (2013.01); *A63B 21/225* (2013.01); *A63B 22/0023* (2013.01); *A63B 22/0221* (2015.10); *A63B 24/0087* (2013.01); *A63B 69/16* (2013.01); *A63B 2022/0278* (2013.01); *A63B 2071/065* (2013.01); *A63B 2071/068* (2013.01); *A63B 2071/0625* (2013.01); *A63B 2071/0655* (2013.01); *A63B 2071/0658* (2013.01); *A63B 2071/0661* (2013.01); *A63B 2209/08* (2013.01); *A63B 2220/17* (2013.01); *A63B 2220/18* (2013.01); *A63B 2220/803* (2013.01); *A63B 2220/805* (2013.01); *A63B 2225/20* (2013.01); *A63B 2225/50* (2013.01); *A63B 2225/685* (2013.01); *A63B 2230/06* (2013.01); *A63B 2230/75* (2013.01)

(58) Field of Classification Search

USPC ..... 482/54

See application file for complete search history.

(56) References Cited

U.S. PATENT DOCUMENTS

| | | | | |
|---|---|---|---|---|
| 4,614,337 A | | 9/1986 | Schonenberger | |
| 5,643,144 A | * | 7/1997 | Trulaske | A63B 22/02 198/841 |
| 5,709,632 A | | 1/1998 | Socwell | |
| 6,053,848 A | | 4/2000 | Eschenbach | |
| 8,002,674 B2 | * | 8/2011 | Piaget | A63B 22/0214 482/52 |

(Continued)

*Primary Examiner* — Stephen R Crow

(74) *Attorney, Agent, or Firm* — Holland & Hart LLP

(57) ABSTRACT

A treadmill has an exercise deck, and a tread belt disposed on the exercise deck. The treadmill further has a tensioning mechanism attached to the exercise deck, and the tensioning mechanism has a selectively movable structure movable with respect to the exercise deck to push outward against an inward surface of the tread belt.

18 Claims, 8 Drawing Sheets

(56) References Cited

U.S. PATENT DOCUMENTS

| | | | | |
|---|---|---|---|---|
| 8,113,994 | B2 * | 2/2012 | Piaget | A63B 22/0292 482/52 |
| 8,690,738 | B1 | 4/2014 | Astilian | |
| 8,790,222 | B2 * | 7/2014 | Burger | A63B 21/0087 482/51 |
| 9,039,580 | B1 | 5/2015 | Bayerlein et al. | |
| 2012/0010053 | A1 | 1/2012 | Bayerlein et al. | |
| 2012/0270705 | A1 | 10/2012 | Lo | |

* cited by examiner

TREADMILL WITH A TENSIONING MECHANISM FOR A SLATTED TREAD BELT

RELATED APPLICATIONS

This application claims priority to U.S. Patent Application Ser. No. 62/085,196 titled "Treadmill with a Tensioning Mechanism for a Slatted Tread Belt" and filed on 26 Nov. 2014, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming and cycling, among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to have an aerobic workout indoors. One such type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck or other controls. Other popular exercise machines that allow a user to perform aerobic exercises indoors include ellipticals, rowing machines, stepper machines and stationary bikes, to name a few.

One type of treadmill is disclosed in U.S. Patent Publication No. 2012/0010053 issued to Douglas G. Bayerlein, et al. In this reference, a manually operated treadmill and methods of using the same are provided. The treadmill includes a treadmill frame having a front end and a rear end opposite the front end, a front shaft rotatably coupled to the treadmill frame at the front end, a rear shaft rotatably coupled to the treadmill frame at the rear end, and a running belt including a curved running surface upon which a user of the treadmill may run. The running belt is disposed about the front and rear shafts such that force generated by the user causes rotation of the front shaft and the rear shaft and also causes the running surface of the running belt to move from the front shaft toward the rear shaft. The treadmill is configured to control the speed of the running belt to facilitate the maintenance of the contour of the curved running surface. Another type of treadmill is described in U.S. Pat. No. 8,690,738 issued to Alex A. Astilian, et al. Each of these references is herein incorporated by reference for all that they contain.

SUMMARY

In one aspect of the invention, a treadmill has an exercise deck.

In one aspect of the invention, a tread belt is disposed on the exercise deck.

In one aspect of the invention, the treadmill includes a tensioning mechanism attached to the exercise deck.

In one aspect of the invention, the tensioning mechanism comprises a selectively movable structure movable with respect to the exercise machine to push outward against an inward surface of the tread belt.

In one aspect of the invention, the movable structure has a pivot end that allows the movable structure to pivot outward to apply tension on the tread belt.

In one aspect of the invention, the tread belt comprises multiple slats.

In one aspect of the invention, at least one slat of the multiple slats comprising an axle with a first end and a second end.

In one aspect of the invention, the tread mill includes a first track defined in a first side of the exercise deck and a second track defined in a second side of the exercise deck.

In one aspect of the invention, the first track receives and guides the first end of the at least one slat, and the second track receives and guides the second end of the at least one slat.

In one aspect of the invention, the first end comprises a first low friction element that is shaped to move within the first track, and the second end comprises a second low friction element that is shaped to move within the second track.

In one aspect of the invention, the first low friction element is a first wheel shaped to roll within the first track, and the second low friction element is a second wheel shaped to roll within the second track.

In one aspect of the invention, the first low friction element is a first bearing shaped to slide within the first track, and the second low friction element is a second bearing shaped to slide within the second track.

In one aspect of the invention, the treadmill includes a first step formed in the first track and a second step formed in the second track, wherein the first step and the second step collectively align the multiple slats of the tread belt.

In one aspect of the invention, the first track and the second track comprise a curved section spanning between a front section and a rear section of the exercise deck.

In one aspect of the invention, the treadmill includes an engagement feature formed in an underside of the at least one slat that is arranged to rotate a connector.

In one aspect of the invention, the connector is connected to a flywheel such that as the tread belt moves, the flywheel stores rotational energy that resists changes in a speed of tread belt.

In one aspect of the invention, the engagement feature is a protrusion formed along a length of the slat.

In one aspect of the invention, the first track forms a first partial loop in the first side of the exercise deck, and the second track forms a second partial loop in the second side of the exercise deck.

In one aspect of the invention, the first partial track comprises a first track entrance and a first track exit where the tread belt hangs between the first track entrance and the first track exit and the second partial track comprises a second track entrance and a second track exit where the tread belt hangs between the second track entrance and the second track exit.

In one aspect of the invention, the movable structure is arranged to apply tension to the inward surface of the tread belt outside of the track between the first and second track entrances and the first and second track exits.

In one aspect of the invention, the tread belt is movable based on a position of a user on the tread belt.

In one aspect of the invention, at least two of the multiple slats is joined to the axle.

In one aspect of the invention, a treadmill includes an exercise deck.

In one aspect of the invention, a tread belt comprising multiple slats is disposed on the exercise deck.

In one aspect of the invention, the treadmill includes a tensioning mechanism attached to the exercise deck;

In one aspect of the invention, the tensioning mechanism comprises a selectively movable structure movable with respect to the exercise deck to push outward against an inward surface of the tread belt.

In one aspect of the invention, the movable structure comprising a pivot end that allows the movable structure to pivot outward to apply tension on the tread belt.

In one aspect of the invention, at least one slat of the multiple slats comprising an axle with a first end and a second end.

In one aspect of the invention, the treadmill includes a first track defined in a first side of the exercise deck and a second track defined in a second side of the exercise deck.

In one aspect of the invention, the first track receives and guides the first end of the at least one slat, and the second track receives and guides the second end of the at least one slat.

In one aspect of the invention, the first track forms a first partial loop in the first side of the exercise deck, and the second track forms a second partial loop in the second side of the exercise deck.

In one aspect of the invention, the first partial track comprises a first track entrance and a first track exit where the tread belt hangs between the first track entrance and the first track exit and the second partial track comprises a second track entrance and a second track exit where the tread belt hangs between the second track entrance and the second track exit.

In one aspect of the invention, the movable structure is arranged to apply tension to the inside of the tread belt outside of the track between the first and second track entrances and the first and second track exits.

In one aspect of the invention, the first track and the second track comprise a curved section spanning between a front section and a rear section of the exercise deck.

In one aspect of the invention, a treadmill has an exercise deck.

In one aspect of the invention, a tread belt is disposed on the exercise deck.

In one aspect of the invention, the treadmill includes a tensioning mechanism attached to the exercise deck.

In one aspect of the invention, the tensioning mechanism comprises a selectively movable structure movable with respect to the exercise machine to push outward against an inward surface of the tread belt.

In one aspect of the invention, the movable structure includes a pivot end that allows the movable structure to pivot outward to apply tension on the tread belt.

In one aspect of the invention, at least one slat of the multiple slats comprising an axle with a first end and a second end.

In one aspect of the invention, the treadmill includes a first track defined in a first side of the exercise deck and a second track defined in a second side of the exercise deck.

In one aspect of the invention, the first track receives and guides the first end of the at least one slat, and the second track receives and guides the second end of the at least one slat.

In one aspect of the invention, the first track forms a first partial loop in the first side of the exercise deck, and the second track forms a second partial loop in the second side of the exercise deck.

In one aspect of the invention, the first partial track comprises a first track entrance and a first track exit where the tread belt hangs between the first track entrance and the first track exit and the second partial track comprises a second track entrance and a second track exit where the tread belt hangs between the second track entrance and the second track exit.

In one aspect of the invention, the movable structure is arranged to apply tension to the inside of the tread belt outside of the track between the first and second track entrances and the first and second track exits.

In one aspect of the invention, the first track and the second track comprise a curved section spanning between a front section and a rear section of the exercise deck.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

The principles described herein include a treadmill that has an exercise deck with a slatted tread belt. Such a tread belt may include multiple slats that span from a first side of the exercise deck to a second side of the exercise deck. At least one of the slats may include an axle with a first rod end and a second rod end. The first rod end of the axle may be received in a first track formed in the first side of the exercise deck, and the second end of the axle may be received in a second track formed in the second side of the exercise deck.

The first track is configured to guide the first rod end of the slat or slats, and the second track is configured to guide the second end of the slats or slats.

Figure 1:
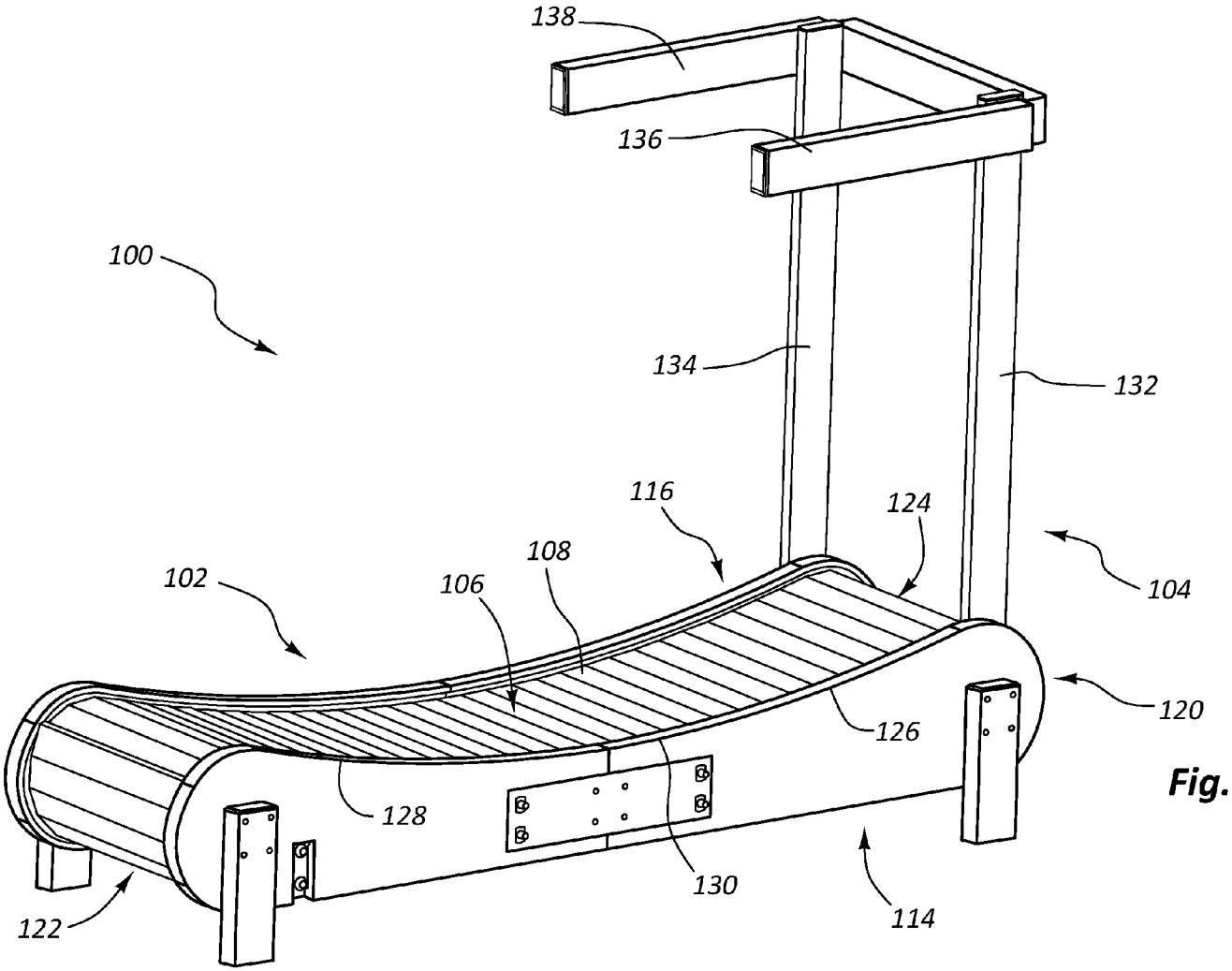
FIG. 1 illustrates a perspective view of an example of a treadmill in accordance with the present disclosure.

Particularly, with reference to the figures, FIG. 1 depicts an example of a treadmill 100. The treadmill 100 includes an exercise deck 102 that can support the weight of a user, a user with his or her bicycle, a user with other types of exercise/athletic equipment or combinations thereof. The exercise deck 102 is also attached to a frame 104. The exercise deck 102 includes a tread belt 106 that comprises multiple slats 108. Each of the slats 108 may be connected to each other to form an endless belt. Further, the slats 108 of the tread belt 106 may include axles that extend beyond a body of the slats 108. The ends of the slats may protrude into tracks formed in the first side 114 and the second side 116 of the exercise deck 102. The axles may be made of a rigid material that has sufficient strength to support the weight of the user and/or associated bicycle or other equipment when the first and second ends of the axles protrude into the first and second tracks of the first and second sides 114, 116 of the exercise deck 102, respectively.

The first and second tracks may comprise a curved section 118 spanning between a front section 120 and a rear section 122 of the exercise deck 102. Accordingly, the surface 124 of the tread belt 106 on which the user may exercise may follow the same curve creating a curved profile. Such a profile may include a forward slope 126 and a rearward slop 128 with a depression 130 formed there between. In some examples, the forwards slope 126 and the rearward slopes 128 have continuously changing radii. In such an example, the steepness of the forward and rearward slopes 126, 128 may increase as the slopes 126, 128 increase in elevation. Such a curved profile may allow a user to control the speed at which the tread belt 106 moves along the first and second tracks. For example, the user may take a first step on the forward slope 126. The stepping action of the user may propel the portion of the tread belt 106 in the forward slope 126 towards the depression 130 in a first direction. The speed at which the tread belt 106 may move may be based on the user's weight, a pushing force exerted by the user during the step, the amount of friction between the track and the first and second ends of the slat's axles 108, the steepness of the forward slope where the user steps, and any momentum presently moving the tread belt 106 during the step. In examples where the steepness of the forward slope 126 progressively decreases towards the depression 130 and progressively increases towards the front of the treadmill 100, the user can cause the tread belt 106 to move faster by stepping farther up towards the front of the treadmill 100. Similarly, the user can induce a weaker propelling force to drive the tread belt 106 by stepping in the forward slope 126 closer to the depression 130 where the steepness is lower.

If the user steps onto the tread belt 106 within the rearward slope 128, the user can generate an opposing force that resists the movement of the tread belt 106 in the first direction because the weight of the user will generate a force to move the user towards the depression 130 from the rearward slope 126 in the second direction. In some cases, such an opposing force may be greater than the force propelling the tread belt 106 in the first direction. In other examples, the opposing force may not overcome the forces propelling the tread belt 106 in the first direction resulting in only slowing down the movement of the tread belt 106. Further, the user may generate a greater opposing force by stepping on a portion of the tread belt 106 with a greater steepness within the rearward slope 126. Thus, as described above, such a treadmill 100 may be self-powered by the user.

The frame 104 of the treadmill may include a first frame post 132 and a second frame post 134 connected by a cross bar. A first rail 136 and a second rail 138 may be attached to the frame 104 on which a user can support himself or herself during exercise. In some examples, the user may operate a bicycle on the treadmill 100. In such an example, the handles or another portion of the bicycle may be connected to the first and second rail 136, 138 to add stability to the bicycle during operation. In such an example, the connection to the rails 136, 138 may fix the position of the bicycle along the length of the exercise deck 102. In other examples, such a connection may allow the bicycle to move forward or backward along the length of the exercise deck 102 as the user operates the bicycle which may allow the user to use another variable to control the speed at which the tread belt 106 moves. In some examples, such a connection may also allow the bicycle to tilt from side to side during operation.

While not shown in the example of FIG. 1, the treadmill 100 may include a console that allows the user to perform a predetermined task while simultaneously operating an tread belt 106. Such a console may allow the user to position an electronic device, such as a phone, tablet, laptop, radio or other device within a convenient arm's reach of the user while operating the treadmill 100. Such an electronic device may include music, videos or other motivational types of content that may be viewed, heard or otherwise experienced during the user's workout. In some examples, the console may incorporate speakers and/or a video display to provide such motivational content.

In some situations, the console may include input mechanism which can control at least some of the operating parameters of the treadmill 100 such as an amount of resistance to apply to the movement of the tread belt 106, a height of the console, a volume of the speaker, a duration a timer, an incline of the exercise deck 102, a view on the display, a distance traveled by the user, other operating parameters or combinations thereof. In other examples, the user's heart rate or other physiological parameters during the workout may be displayed to the user through the console. In such examples, a sensor that is incorporated into the console or another portion of the treadmill 100 may be used to track and communicate the physiological parameters to the display. In yet other examples, the user may carry and/or wear a physiological sensor that tracks and communicates the parameters to the display. Buttons, levers, touch screens, voice commands or other mechanisms may be incorporated into the console and can be used to control the parameters mentioned above. Information relating to these functions may be presented to the user through the display. For example, a calorie count, a timer, a distance, another type of information or combinations thereof may be presented to the user through the display. Further, such an example may include a wireless transceiver or a cable connector to receive instructions to control at least one operational parameter from a remote device.

Figure 2:
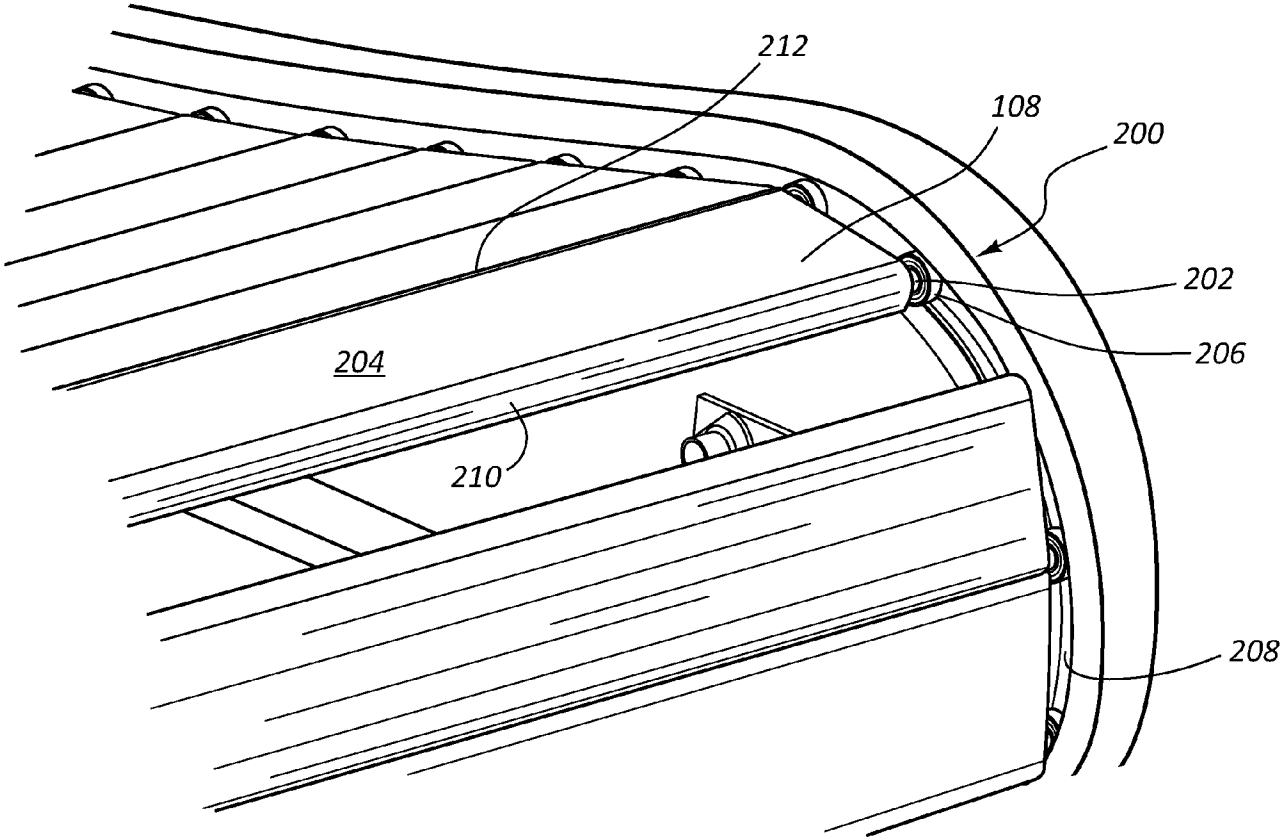
FIG. 2 illustrates a close up view of the treadmill depicted in FIG. 1 with a portion of a slat disconnected.

FIG. 2 illustrates a close up view of the treadmill 100 depicted in FIG. 1 with a portion of a slat disconnected and rotated up for illustrative purposes. In this example, the first rod end 200 of the axle 202 protrudes from a body 204 of the slats 108. A first low friction element 206 is disposed on the first rod end 200. While not shown in FIG. 2, a second low friction element is disposed on the second end of the axle 202. In this example, the low friction element 206 is a wheel that is shaped and sized to roll within the first track 208 formed in the first side 114. Such a wheel may be configured to roll in either the first direction or the second direction. The principles described herein may include the use of other types of low friction elements, other than wheels, that may be used to position and/guide the slats as they move in either the first direction and/or the second direction. For example, a low friction surface, such as a plane bearing 700 depicted in FIG. 7 may be used. Further, other types of low friction elements, such as rollers, ball bearings, thrust bearings, tapered bearings, magnetic bearings, other types of bearings or combinations thereof may be used in accordance with the present disclosure.

In the illustrated example, each slat 108 has more than one axle with a first axle disposed within the slats proximate a first edge 210 and a second axle disposed within the slats proximate a second edge 212. By using two axles proximate the edges 210, 212, the slats 108 are supported on both sides of the slats 108 as the tread belt 106 moves. However, any appropriate number of axles may be associated with each slat 108. For example, a central axle may be incorporated into to slats the along with the first and second axles incorporated into the slats proximate the slats' edges 210, 212. In other examples, a single axle may be incorporated into each of the slats 108 to transfer the weight of the user from the slats 108 into the tracks. In such an example, the edges 210, 212 of the slats 108 may be connected to their respective adjacent slats for stability such that the slats 108 maintain their relative orientation as the tread belt 106 moves.

In an alternative example, the low friction elements are supported by an axle that does not extend from the first track 208 to the second track. In such an example, multiple axles may be secured to the slats 108 on both sides with a sufficient length to support the slats 108 under the loads imposed on the slats 108 during a user's workout, but such axles may extend only partially along the slats' lengths. For example, the axle's length may be just an inch. In such an example, the axle may be bonded to or inserted into the thickness of the slat 108 at a depth of less than an inch. The depth of the axle connected to the slats may be sufficient to form a strong connection between the axle and the slats as well as transfer the loads associated with the user exercising on the treadmill 100 from the slats to the track. While this example has been described with reference to such axles being an inch long, any appropriate length may be used, such as less than an inch, more than an inch, several inches, a foot, a different length or combinations thereof. In such an example, the slats 108 may be made of a material or have a structure with a sufficient strength to prevent the slats 108 from plastically deforming during the user's workout. In examples where the first and second rod ends are connected by a single axle, the material and/or structure of the axle may have the characteristics to prevent plastic deformation during the user's workout allowing the slats 108 to be made a material that would otherwise plastically deform during the user's workout without the support of the axles.

Figure 3:
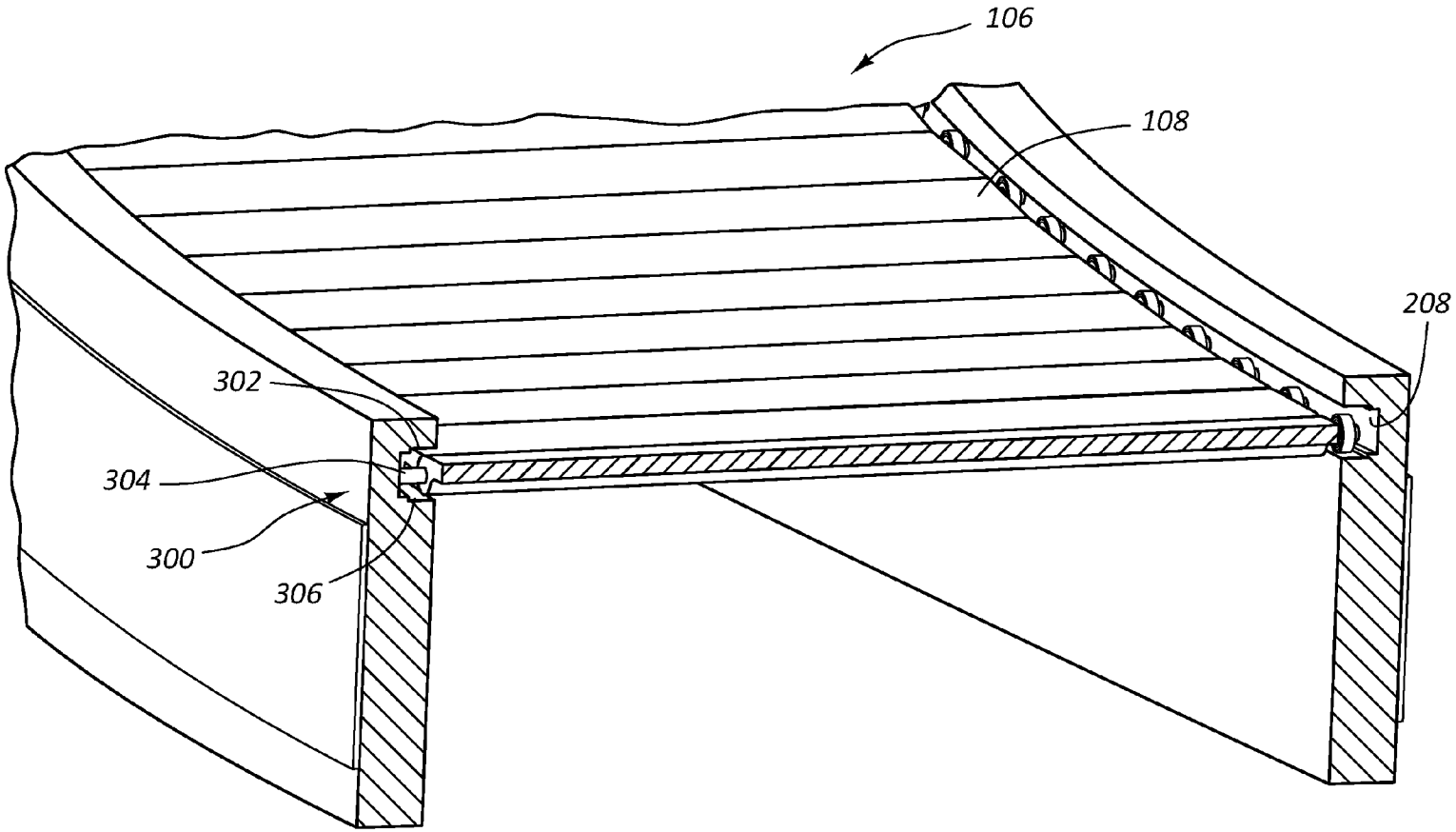
FIG. 3 illustrates a cross sectional view of an exercise deck of the treadmill depicted in FIG. 1.

FIG. 3 illustrates a cross sectional view of an exercise deck of the treadmill depicted in FIG. 1. In this example, the axle spans from the first track 208 to the second track 300. The first and second tracks 208, 300 each form a partial loop within the first side 114 and the second side 116 of the treadmill 100, respectively. The first and second tracks 208, 300 may be formed by a recess formed in the first and second sides 114, 116 of the treadmill 100. Such a recess may have an upper surface 302, a side surface 304 and a bottom surface 306 when the treadmill 100 is in an upright position. The first and second tracks 208, 300 may position the slats 108 to form the surface profile of the tread belt 106 on which the user performs his or her workout.

The first and second tracks 208, 300 may each include a step 312 formed in the upper surfaces 302 and the bottom surfaces 306 that controls how far over the wheel can be within the track. In such an example, the step 312 may be offset from the side surface 304 of the recess. By offsetting the step 312 from the side surface 304, the ends of the axle/rod may protrude through the entire wheel which may provide additional stability to the connection between the wheel and the rod ends. Additionally, the lengths of the axle/rods may be constrained within looser tolerances while positioning the wheels within a tighter range. In some examples, the step 312 maintains the lateral displacement of each slat 108 of the tread belt 106 to be within a range compatible with the tread belt 106 moving along the first and second tracks 208, 300.

Figure 4:
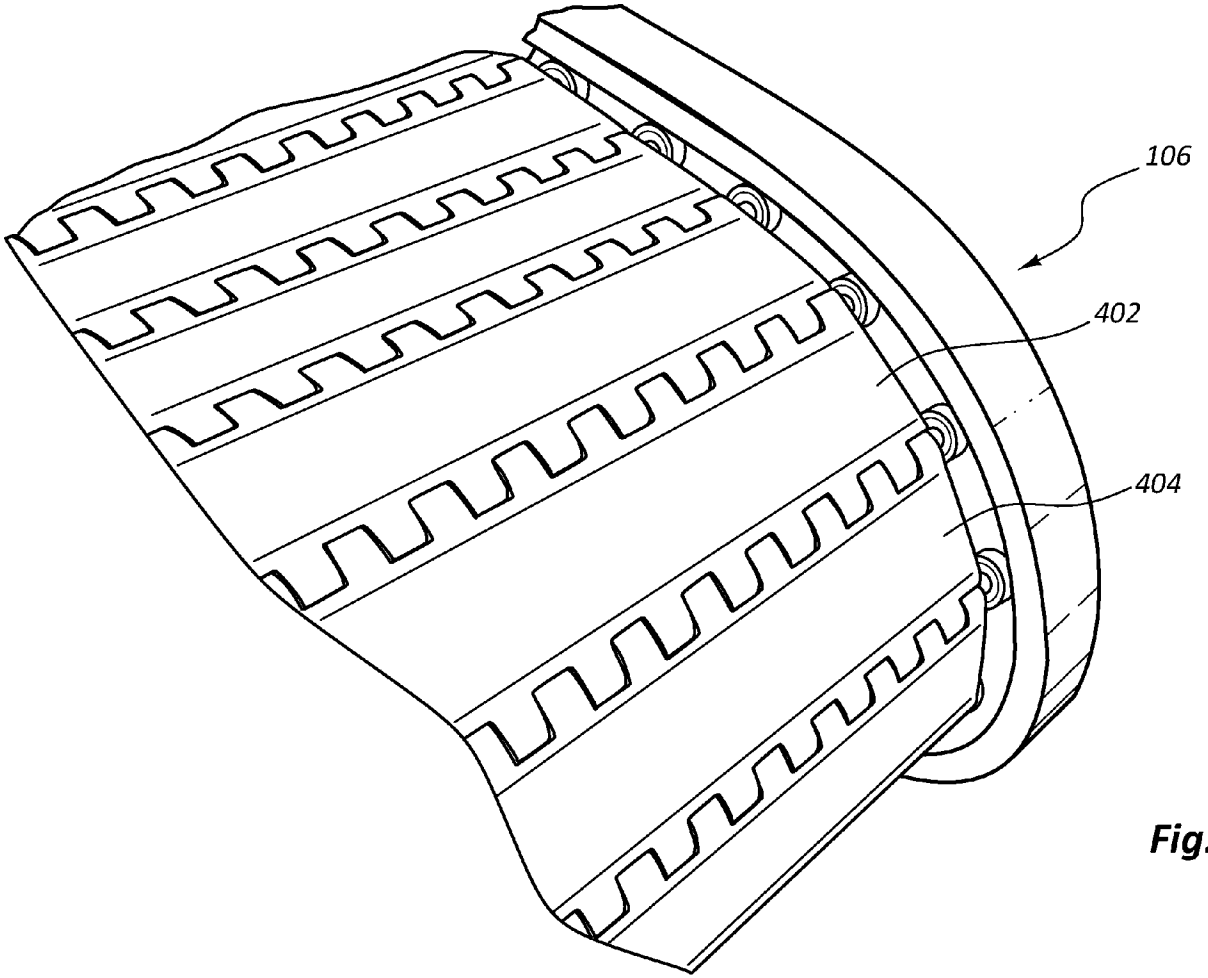
FIG. 4 illustrates a close up view of an example of slats in accordance with the present disclosure.
Figure 5:
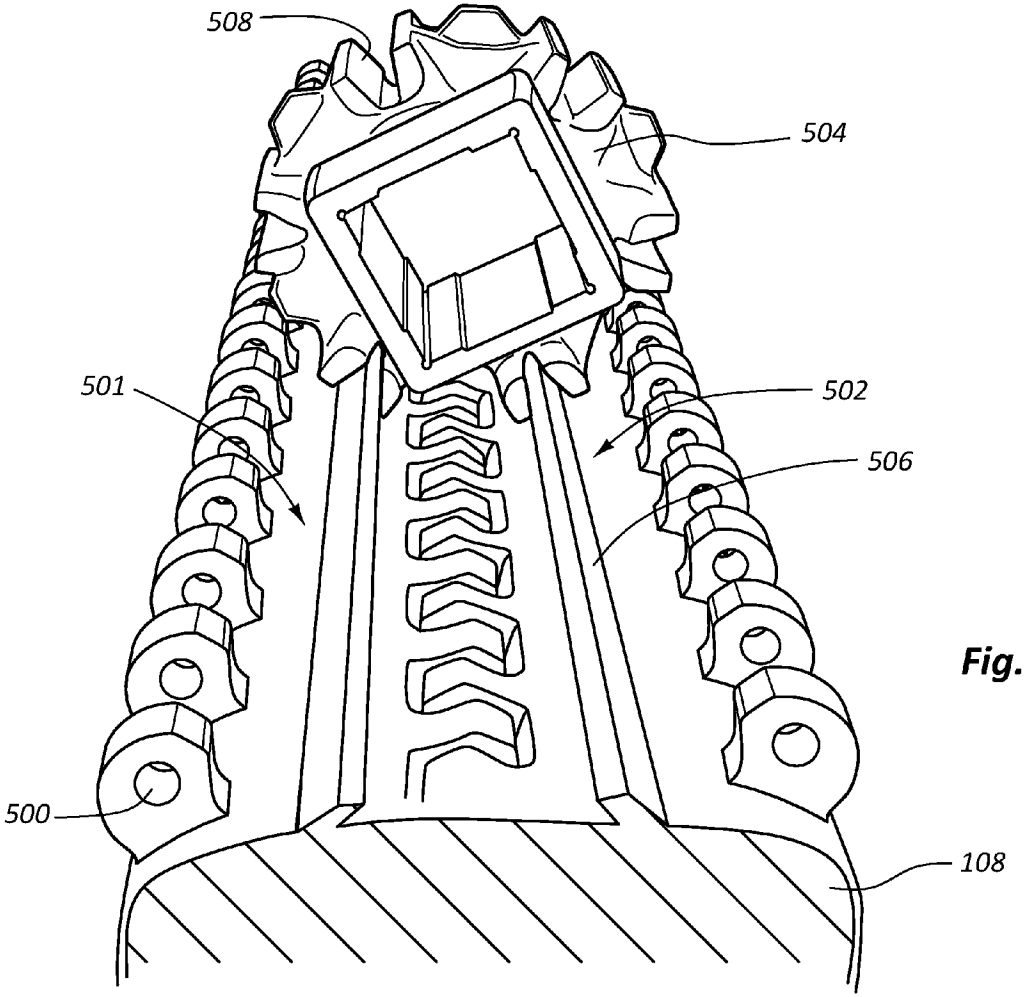
FIG. 5 illustrates a perspective view of an example of a connector engaged with an example of an underside of a tread belt in accordance with the present disclosure.

FIGS. 4 and 5 illustrate an example of the slats in accordance with the present disclosure. In this example, the slats 108 include intermeshing tongues 400 that attach to an axle through openings 500 formed in the tongues 400. In such an example, every other tongue 400 is from a first slat 402 and the remaining tongues 400 are from a second slat 404. In such an example, the slats 402, 404 can rotate about the axles as the tread belt 106 travels along the curved portions of the tracks 208, 300. The curved portions of the tracks 208, 300 may include the regions of the track forming the forward slope 126 and the rearward slope 128 as well as the portion of the tracks 208, 300 that are proximate the tracks' entrances and exists.

An underside 501 of the slats 402, 404 may include features 502 that can attach to a connector 504. The connector 504 may transfer forces from the movement of the tread belt 106 to a device such as a flywheel, a sensor, another type of device or combinations thereof. Such a device may reside between the sections of the tread belt 106 that are supported by the tracks 208, 300 and another portion of the tread belt 106 that is unsupported by the track and hangs between the tracks' entrances and exists. In some examples, the connector 504 is a sprocket gear, a roller, another type of connector or combinations thereof. In some examples, such a connector 504 may be used to apply tension to the tread belt 106.

In the illustrated example, the features 502 include a lengthwise protrusion 506 that can be gripped by a slot 508 formed in the connector 504 as the underside 501 of the slats 402, 404 pass by. As such, the slots 508 may be shaped such that they engage the protrusions as the slats 402, 404 approach. The movement of the tread belt 106 causes the connector 504 to rotate. As the connector 504 rotates and the slats 402, 404 move away from the location where the connector is located, the connection features 502 are shaped to slip out of the slots 508. While the example above has been described with reference to a specific arrangement of connection features 502, any appropriate type of connection features 502 that are compatible with gripping the slats may be used in accordance with the present disclosure. For example, gear teeth, rough surfaces, paddles, other types of protrusions, other types of features, magnets, hooks or combinations thereof may be used.

The inside of the connector 504 may be shaped to hold a portion of the device or a mechanism that is connected to the device. In the illustrated example, the inside of the connector 504 has a square shape that is configured to receive a square shaped object. However, the inside of the connector 504 may have any appropriate type of shape to receive any appropriately shaped object or portion of an object. The connector 504 may cause such an object to rotate as the tread belt 106 moves.

Figure 6:
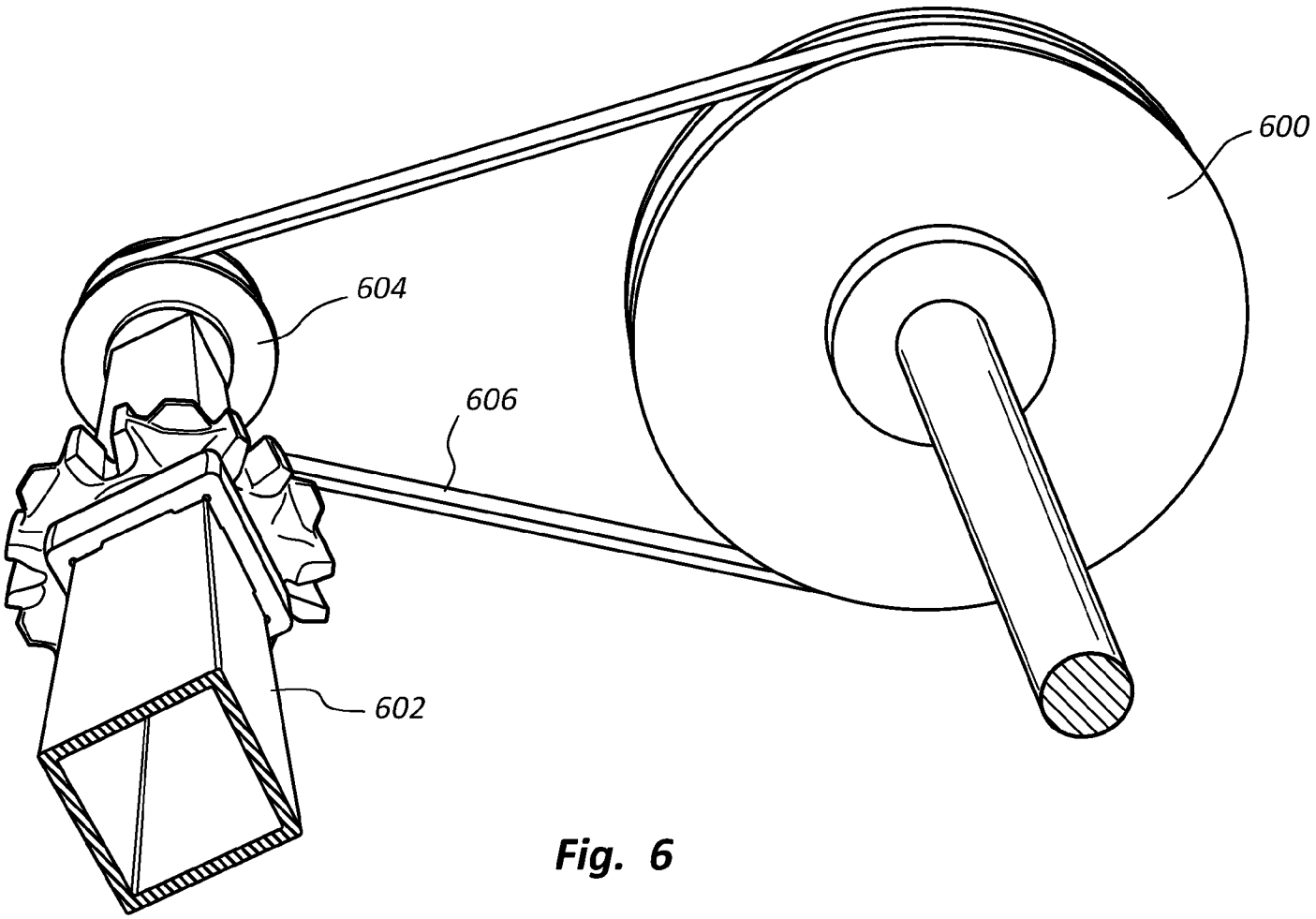
FIG. 6 illustrates a perspective view of the connector depicted in FIG. 5 mechanically linked to an example of a flywheel.

FIG. 6 illustrates a perspective view of the connector 504 depicted in FIG. 5 mechanically linked to an example of a flywheel 600. In this example, the inside of the connector 504 is attached to a square shaped axle 602 that rotates as the connector 504 is rotated by the movement of the tread belt 106. A pulley 604 is connected to the square shaped axle 602 that is linked to the flywheel 600 through a driving belt 606. Thus, as the tread belt 106 moves, the flywheel 600 will rotate. The movement of the flywheel 600 may generate momentum that resists changes in the tread belt's movement. As such, the movement of the flywheel 600 may cause the tread belt 106 to assist with maintaining a speed at which the user runs or walks. In other examples, a resistance mechanism may be applied to the flywheel 600 to resist the movement of the flywheel 600 and thereby resist movement of the tread belt 106. Such resistance may be applied when a user desires a harder workout and may be controlled through the console, controlled with a remote device or manually adjusted with a mechanism incorporated into the treadmill 100.

In some examples, the number of rotations of the flywheel 600 can be counted with a sensor or tracked with another type of mechanism. Such a flywheel rotation count can be used to determine how many times the flywheel has rotated, how fast the flywheel 600 is rotating and other parameters about the user's workout. Such parameters may be used to determine an amount of calories burned during the user's workout, the force the user is exerting to run or walk, the distance that the user has traveled, other parameters or combinations thereof.

A sensor can be arranged to track the rotational position of the flywheel 600. As the flywheel 600 rotates from the movement of the tread belt 106, the sensor can track the number of times that the flywheel 600 rotates. In some examples, the sensor may track half revolutions, quarter revolutions, other fractional revolutions or combinations thereof.

The sensor may be any appropriate type of sensor that can determine the rotational position of the flywheel 600. The sensor may be a mechanical sensor, an optical sensor, a magnetic sensor, a capacitive sensor, a geared multi-turn sensor, an incremental sensor, another type of sensor or combinations thereof. In some examples, a visual code may be depicted on the flywheel body and the sensor may read the orientation of the visual code to determine the number of revolutions or partial revolutions. In other examples, the flywheel body includes at least one feature that is counted as the features rotate with the flywheel body. In some examples, a feature is a magnetic feature, a recess, a protrusion, an optical feature, another type of feature or combinations thereof.

The sensor can send the number of revolutions and/or partial revolutions to a processor as an input. The processor can also receive as an input the level of resistance that was applied to the flywheel when the revolutions occurred. As a result, the processor can cause the amount of energy or number of calories burned to be determined. In some examples, other information, other than just the calorie count, is determined using the revolution count. Further, the processor may also use the revolution count to track when maintenance should occur on the machine and/or send a message to the user indicating that maintenance should be performed on the machine based on usage. Such a processor may be incorporated into the treadmill 100. In other examples, such a processor is located at a remote location and communicates with the sensors and presentation mechanism through a network, wireless signal, hard wired signal, satellite, another communication mechanism or combinations thereof. In yet other examples, portions of the processing resources are incorporated into the treadmill 100 and other portions of the processing resources are in remote communication with the treadmill 100.

The number of calories burned by the user may be presented to the user in a display of the console. In some examples, the calories for an entire workout are tracked and presented to the user. In some examples, the calorie count is presented to the user through the display, through an audible mechanism, through a tactile mechanism, through another type of presentation mechanism or combinations thereof.

Figure 7:
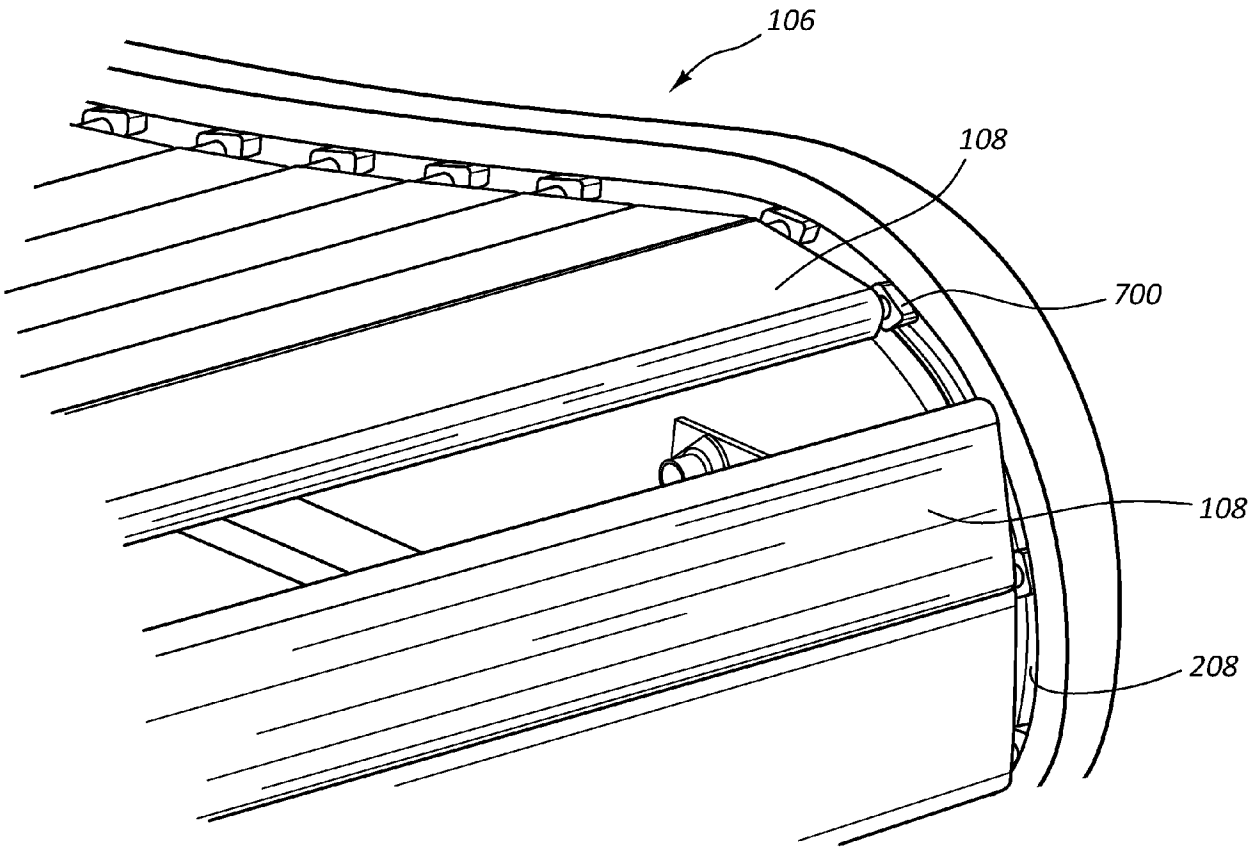
FIG. 7 illustrates a perspective view of a treadmill with an example of bearings connected to slats of a tread belt.

FIG. 7 illustrates a perspective view of a treadmill 100 with an example of plane bearings 700 connected to slats 108 of a tread belt 106. In this example, the low friction elements located at the ends of the rod/axle comprise plane bearings 700 that are configured to slide along the first and second tracks 208, 300. Such plane bearings 700 may be made of a hard material that can still slide under pressure. Such plane bearings 700 may be rigidly fixed to an axle where the axle rotates as the plane bearings 700 change angle and/or orientation as they move along the first and/or second track 208, 300.

Figure 8:
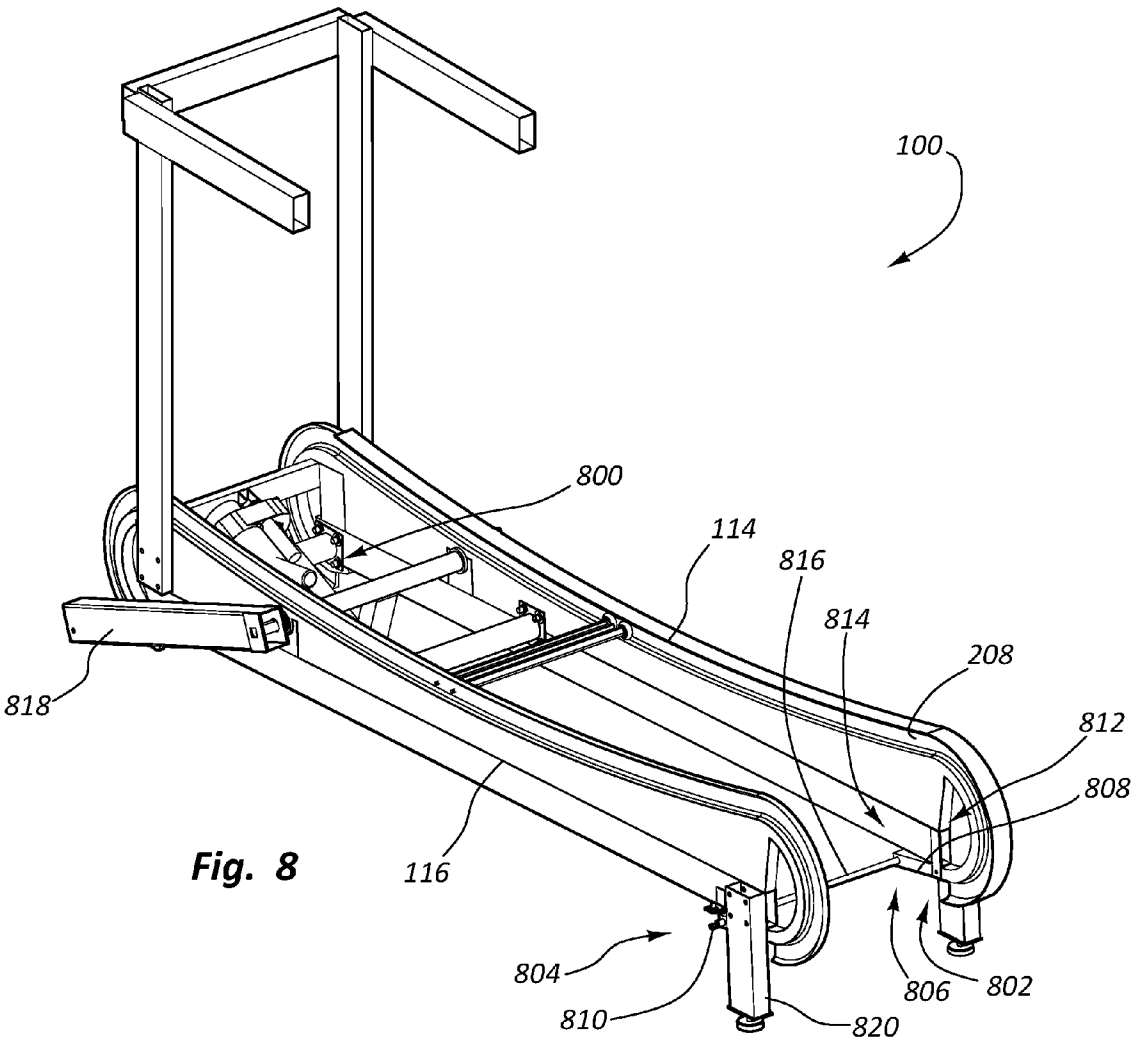
FIG. 8 illustrates a perspective view of an example of a treadmill in accordance with the present disclosure.

FIG. 8 illustrates a perspective view of an example of a treadmill in accordance with the present disclosure. In this example, a majority of the slats 108 of the tread belt 106 are removed to depict the first track 208 with a track entrance 800 and a track exit 802 at the track ends. While the tread belt 106 forms a continuous loop, the first and second tracks 208, 300 form just a partial loop leaving a section of the tread belt 106 supported and another section of the tread belt 106 unsupported. The supported section of the tread belt comprises slats 108 that have rod ends protruding into the tracks 208, 300. The unsupported section of the tread belt 106 does not have rod ends that are currently protruding into the tracks 208, 300. This unsupported section hangs between the track entrance 800 and the track exit 802.

As the tread belt 106 moves in the first direction propelled by the user's exercise activity on the exercise deck 102, the slats 108 of the tread belt 106 in the supported section move along the first and second tracks 208, 300 approaching the track exits 802 located at a rear end of the treadmill 100 where the slats transition from a supported state to an unsupported state. As the tread belt 106 continues to move in the first direction, the slats 108 reenter the tracks 208, 300 at the track entrances 800 located at a front end of the treadmill 100. While this example is described with specific reference to the track entrances 800 being located at a front end of the treadmill 100 and a track exit 802 being located at a rear end of the treadmill 100, it is understood that if the tread belt 106 were moving in the second direction that the track entrance 800 would be located at the rear end of the treadmill 100 and the track exit 802 would be located at a front end of the treadmill 100. Further, while the illustrated example is described with specific reference to the track entrances 800 and track exits 802 being located at ends of the treadmill 100, such entrances 800 and exits 802 may be located at any appropriate location. For example, a track entrance 800 and/or a track exit 802 may be located in a midsection of the treadmill 100. Further, a track entrance 800 and/or a track exist 802 may be located on an underside of the exercise deck 102, a top side of the exercise deck 102, a side of the exercise deck 102, another appropriate location or combinations thereof.

In the example of FIG. 8, a tension mechanism 804 is located in a rear end of the treadmill 100 proximate the track exit 802. The tensioning mechanism 804 includes a movable structure 806 that is configured to push outward against an inward surface of the tread belt 106. Such an inward surface of the tread belt 106 may be the underside of the slats 108 that is opposite the side of the slats 108 where the user, bike or another type of exercise device make contact with the slatted tread belt 106. This outward force may adjust the tension on the tread belt 106. For example, in situations where the tread belt 106 is being installed on the treadmill 100, the tensioning mechanism 804 may be adjusted to take the slack out of the tread belt 106 after the tread belt 106 is properly positioned in the treadmill 100. Likewise, in situations where maintenance is performed on a device within the exercise deck 102 or on one of the slats 108, slack may be put into the tread belt 106 by adjusting the movable structure 806 to reduce or stop applying the outward force on the inward surface of the tread belt 106. Further, the tension on the tread belt 106 may be adjusted to prevent the tread belt 106 from slipping during workouts.

The movable structure 806 depicted in FIG. 8 includes a first arm 808 and a second arm 810 with pivot ends 812 connected to the first and second sides 114, 116 of the treadmill 100. The tension end 814 of the first and second arms 808, 810 are attached to a tension rod 816. As the tread belt 106 moves, the underside of the slats 108 rides around the tension rod 816, which spans the distance between the first and second arms 808, 810. As the first and second arms 808, 810 pivot outward, they position the tension rod 816, which determines the amount of tension applied to the tread belt 106.

While this example has been described with a tension rod, any appropriate mechanism may be used to interface with the inward surface of the tread belt 106. For example, such mechanisms may include low friction surfaces that allow the undersides of the slats to ride over the portion of the movable structure 806 that contacts the tread belt 106. In other examples, portion of the movable structure 806 that contacts the tread belt 106 may temporarily interlock with the slats as the pass, such as gears, gear sprockets, other types of mechanisms or combinations thereof. In some examples, wheels rods or other rotatable features are incorporated into the movable structure 806 and configured to contact the tread belt 106.

In some examples, the movable structure 806 of the tension mechanism 804 is spring loaded to urge the movable member 806 to a position that automatically applies tension to the tread belt 106. In such an example, the tension is applied automatically, but the spring loaded force may be overcome in moments where an external force puts additional tension on the tread belt 106. In such circumstances, the spring loaded force is not so strong so as to prevent the movable member 806 from moving. Such give in the system reduces the amount of stress imposed on the tread belt 106 in such circumstances. Such spring mechanisms may include any appropriate type of spring, such as compression springs, coil springs, tension springs, wave springs, torsion springs, variable springs, machined springs, flat springs, cantilever springs, leaf springs, other types of springs or combinations thereof. Other types of mechanisms, other than spring mechanisms, may be used to urge the movable member 806 to an appropriate position. For example, such mechanisms may include magnetic mechanisms, pneumatic mechanisms, hydraulic mechanisms, shape memory alloy mechanisms, other types of mechanism or combinations thereof.

The tension mechanism 804 may be located along any appropriate location of the treadmill 100. For example, the tension mechanism 804 may be located in a region of the tread belt 106 that is unsupported by the first and second tracks 208, 300. In such examples, the tension mechanism 804 may be located in a midsection of the treadmill 100, proximate the front end of the treadmill 100, proximate the rear end of the treadmill 100, adjacent to the track exit 802, adjacent to the track entrance 800, in another position or combinations thereof. In some examples, the tension mechanism 804 is incorporated into the treadmill 100 in a section of the tread belt 106 that is supported by the first and second tracks 208, 300.

While the example in FIG. 8 is described with reference to a specific type of tensioning mechanism, any appropriate type of tensioning mechanism may be used. For example, the tension mechanism 804 does not have to incorporate a pivot end 812 as depicted in FIG. 8. Instead, the tension mechanism 804 may include telescoping arms that extend and retract to apply the appropriate amount of tension to the tread belt 106. Other types of arms may extend through a sliding mechanism, rack and pinion mechanism, a hydraulic mechanism, a pneumatic mechanism, another type of mechanism or combinations thereof.

The tension mechanism 804 may have just two settings. The first setting may be a zero tension setting and the second setting may be a fully tensioned setting. In such an example, the user may cause the tread belt 106 switch between these two settings with a switch or another type of input mechanism. In other examples, the tension mechanism 804 may include at least one intermediate tension setting between the full and zero tension settings. In yet other examples, the tension settings are continuously adjustable between the full tension setting and the zero tension setting.

The user may control the tension setting through any appropriate input mechanism. For example, such an input mechanism may be located on the console, another location of the treadmill 100, a remote device, a networked device, a mobile device, a wireless device, a remote trainer, another type of device or combinations thereof. The input mechanism may be a button, a level, a dial, a slider, a touch screen, a microphone, a camera, another type of mechanism or combinations thereof.

The treadmill 100 may be supported by a pair of front legs 818 and a pair of rear legs 820. In the example of FIG. 8, the front legs 818 may be pivotally adjusted to cause the exercise deck 102 to incline. While this example has been depicted with a specific incline mechanism, any appropriate mechanism for inclining or declining the exercise deck 102 may be used.

While the examples above have been described with specific reference to certain types of low friction elements to move along the tracks, any appropriate type of low friction element may be used in accordance with the principles described in the present disclosure. Also, while the examples above have been described with specific reference to a track shape, any appropriate type of track shape may be incorporated into the treadmill. For example, the tracks may include a flat section to form a flat profile on which the user may walk, run, bike or perform another type of exercise. In other examples, such tracks may be shaped such that the forward slope and/or rearward slope can have different steepness angles or profiles than each other or other than what is depicted in FIG. 1. In yet other examples, the slats may include any appropriate shape. For example, the slats may be wider or thinner than those described above. Further, such slats may be curved or have a non-uniform thickness. For example, the central portions of the slats may have a thicker cross section than those cross sections located towards the ends of the slats.

INDUSTRIAL APPLICABILITY

In general, the invention disclosed herein may provide the user with a self-powered treadmill with multiple slats that travel along a track formed in the sides of the treadmill. The shape of such a track may cause the profile of the slatted tread belt to have a curved profile on which the user can work out. The curved profile may allow the user to control the speed of the tread belt by stepping on portions of the tread belt that have a steepness that corresponds to the speed desired by the user.

The slats may comprise axles or rods that have low friction elements positioned on their ends. Such low friction elements may travel in the tracks. The axle may protrude deeper into the recess of the track than the low friction element. For example, when the low friction element is a wheel, the axle supporting the wheel may protrude deeper into the recess than the wheel. A step formed in the track may position the wheel such that the wheel is offset from a side surface of the recess. Such steps may center the slats between the first and second sides of the treadmill.

A user may control the speed of treadmills described above by stepping on the portions of the forward slope of the tread belt such that the farther forward the user runs, the faster the tread belt goes in the first direction. The farther rearward the user runs, the more that the tread belt slows, the quicker the tread belt stops or the faster that the tread belt travels in the second direction. In some situations, the treadmill includes a mechanism that allows the front end of the treadmill to be inclined.

The slats may be made of any appropriate material. For example, the slats may be made of a metal, a plastic, wood, another type of material or combinations thereof.

A user may utilize the treadmills described above for running, walking, biking, other forms of exercising or combinations thereof. In some cases, the user can attach his or her bicycle to the rails of the treadmill. In some cases, such a treadmill may allow the bicycle to tilt side to side and/or move forward and/or rearward with respect to the exercise deck.

The slats may also be constructed to transfer forces from the tread belt's movement into a connector, such as a sprocket gear or another type of connector, to rotate a device within the exercise deck. Such features that engage the connector may be formed on the underside of the slats. The device may be a flywheel to store the kinetic energy of the moving the tread belt. Storage of such kinetic energy may contribute to the momentum of the tread belt moving at a substantially consistent speed provided that the user exerts a consistent amount of energy and exercises in a substantially consistent position along the length of the exercise deck. Such a device may also be a device that helps determine the speed, distance, duration or other parameters of the user's workout. In yet other examples, such devices may be used to provide additional support to the slats when the user's weight is loaded to the slats. For example, such a device may be positioned adjacent the slats' underside in a midsection of the exercise deck.

The tension of the tread belt may be adjusted to assist with installing and removing the tread belt. In some examples, it may be desirable to loosen or tighten the tread belt based on the tread belt's performance, reduce wear, perform maintenance or accomplish another type of result.

What is claimed is:

1. A treadmill, comprising:

an exercise deck;

a tread belt disposed on the exercise deck;

a tensioning mechanism attached to the exercise deck; and the tensioning mechanism comprising a selectively movable structure movable with respect to the exercise deck to push outward against an inward surface of the tread belt, wherein the movable structure comprising a pivot end that allows the movable structure to pivot outward to apply tension on the tread belt, wherein the tread belt comprising multiple slats;

at least one slat of the multiple slats comprising an axle with a first end and a second end;

a first track defined in a first side of the exercise deck and a second track defined in a second side of the exercise deck;

wherein the first track receives and guides the first end of the at least one slat, and the second track receives and guides the second end of the at least one slat.

2. The treadmill of claim 1, wherein the first end comprises a first low friction element that is shaped to move within the first track, and the second end comprises a second low friction element that is shaped to move within the second track.

3. The treadmill of claim 2, wherein the first low friction element is a first wheel shaped to roll within the first track, and the second low friction element is a second wheel shaped to roll within the second track.

4. The treadmill of claim 2, wherein the first low friction element is a first bearing shaped to slide within the first track, and the second low friction element is a second bearing shaped to slide within the second track.

5. The treadmill of claim 1, further comprising a first step formed in the first track and a second step formed in the second track, wherein the first step and the second step collectively align the multiple slats of the tread belt.

6. The treadmill of claim 1, wherein the first track and the second track comprise a curved section spanning between a front section and a rear section of the exercise deck.

7. The treadmill of claim 1, further comprises an engagement feature formed in an underside of the at least one slat that is arranged to rotate a connector.

8. The treadmill of claim 7, wherein the connector is connected to a flywheel such that as the tread belt moves, the flywheel stores rotational energy that resists changes in a speed of tread belt.

9. The treadmill of claim 7, wherein the engagement feature is a protrusion formed along a length of the at least one slat.

10. The treadmill of claim 1, wherein the first track forms a first partial loop in the first side of the exercise deck, and the second track forms a second partial loop in the second side of the exercise deck.

11. The treadmill of claim 10, wherein the first partial loop comprises a first track entrance and a first track exit where the tread belt hangs between the first track entrance and the first track exit and the second partial loop comprises a second track entrance and a second track exit where the tread belt hangs between the second track entrance and the second track exit.

12. The treadmill of claim 11, wherein the movable structure is arranged to apply tension to the inward surface of the tread belt outside of the first and second tracks between the first and second track entrances and the first and second track exits.

13. The treadmill of claim 1, wherein the tread belt is movable based on a position of a user on the tread belt.

14. The treadmill of claim 1, wherein at least two of the multiple slats is joined to the axle.

15. A treadmill, comprising:

an exercise deck;

a tread belt comprising multiple slats disposed on the exercise deck;

a tensioning mechanism attached to the exercise deck;

the tensioning mechanism comprising a selectively movable structure movable with respect to the exercise deck to push outward against an inward surface of the tread belt;

the movable structure comprising a pivot end that allows the movable structure to pivot outward to apply tension on the tread belt;

at least one slat of the multiple slats comprising an axle with a first end and a second end;

a first track defined in a first side of the exercise deck and a second track defined in a second side of the exercise deck; and wherein the first track receives and guides the first end of the at least one slat, and the second track receives and guides the second end of the at least one slat.

16. The treadmill of claim 15, wherein the first track forms a first partial loop in the first side of the exercise deck, and the second track forms a second partial loop in the second side of the exercise deck.

17. The treadmill of claim 16, wherein the first partial loop comprises a first track entrance and a first track exit where the tread belt hangs between the first track entrance and the first track exit and the second partial loop comprises a second track entrance and a second track exit where the tread belt hangs between the second track entrance and the second track exit.

18. A treadmill, comprising:

an exercise deck;

a tread belt comprising multiple slats disposed on the exercise deck;

a tensioning mechanism attached to the exercise deck;

the tensioning mechanism comprising a selectively movable structure movable with respect to the exercise deck to push outward against an inward surface of the tread belt;

the movable structure comprising a pivot end that allows the movable structure to pivot outward to apply tension on the tread belt;

at least one slat of the multiple slats comprising an axle with a first end and a second end;

a first track defined in a first side of the exercise deck and a second track defined in a second side of the exercise deck;

wherein the first track receives and guides the first end of the at least one slat, and the second track receives and guides the second end of the at least one slat;

the first track forms a first partial loop in the first side of the exercise deck, and the second track forms a second partial loop in the second side of the exercise deck;

the first partial loop comprises a first track entrance and a first track exit where the tread belt hangs between the first track entrance and the first track exit and the second partial loop comprises a second track entrance and a second track exit where the tread belt hangs between the second track entrance and the second track exit;

the movable structure is arranged to apply the tension to the inside of the tread belt outside of the first and second tracks between the first and second track entrances and the first and second track exits; and the first track and the second track comprise a curved section spanning between a front section and a rear section of the exercise deck.

* * * * *